US006304219B1

(12) United States Patent
Rothe

(10) Patent No.: US 6,304,219 B1
(45) Date of Patent: Oct. 16, 2001

(54) RESONANT ANTENNA

(76) Inventor: Lutz Rothe, Am Mühlberg 43, D-06132 Halle (Saale) (DE)

( * ) Notice: Subject to any disclaimer, the term of this patent is extended or adjusted under 35 U.S.C. 154(b) by 0 days.

(21) Appl. No.: 09/380,131

(22) PCT Filed: Feb. 24, 1998

(86) PCT No.: PCT/EP98/01040

§ 371 Date: Nov. 22, 1999

§ 102(e) Date: Nov. 22, 1999

(87) PCT Pub. No.: WO98/38694

PCT Pub. Date: Sep. 3, 1998

(30) Foreign Application Priority Data

Feb. 25, 1997 (DE) ..... 197 07 535

(51) Int. Cl.[7] ..... H01Q 1/38
(52) U.S. Cl. ..... 343/700 MS; 343/846
(58) Field of Search ..... 343/700 MS, 702, 343/826, 829, 830, 795, 846, 848

(56) References Cited

U.S. PATENT DOCUMENTS 5,075,691 12/1991 Garay et al. ..... 343/830
5,663,639 9/1997 Brown et al. ..... 324/96
5,666,091 9/1997 Hikita et al. ..... 333/193
5,748,149 * 5/1998 Kawahata ..... 343/700 MS
5,867,126 * 2/1999 Kawahata et al. ..... 343/702
6,008,762 * 12/1999 Nghiem ..... 343/700 MS
6,049,314 * 4/2000 Munson et al. ..... 343/846

* cited by examiner

*Primary Examiner*—Tan Ho
(74) *Attorney, Agent, or Firm*—Woodbridge & Associates, P.C.; Richard C. Woodbridge

(57) ABSTRACT

An antenna for receiving and transmitting electromagnetic microwaves having λ wavelengths consisting of a substrate layer (10) made of a low dielectric material which bears on one side a conductive ground plane (1) and whose opposite side is conductively structured as micro-strip circuits. The conductive structure (S) has an elongate conductor section (3, 3*a*, 3*b*, R, Ra, Rb) which acts as a resonator and whose length ($L_R$) is shorter than $\lambda_c/4$. One end of said conductor section is conductively connected to the ground plane (8, 1) and its other end is conductively connected to at least another conductor section (2, 2*a*, 2*b*, 4, 42*a*, 42*b*, 46*a*, 46*b*, K) used as an end capacitor to adjust resonance conditions. The conductor section (3, 3*a*, 3*b*, R, Ra, Rb) which acts as a resonator is connected to the inner conductor of a coaxial optical fiber and the outer conductor or the coaxial optical fiber is connected to the ground plane (1).

15 Claims, 6 Drawing Sheets

RESONANT ANTENNA

BACKGROUND OF THE INVENTION

1. Field of the Invention

The invention concerns an antenna intended for reception and transmission of electromagnetic microwaves in the wavelength range of λ and consisting of a substrate layer of low dielectric material that is structured on one side with a conductive ground plane and whose opposing side is conductive in the form of micro-strip circuits.

The area of application of the invention extends fundamentally to the mobile communications and handheld technologies within the spectral range of between 890 MHz and 960 MHz or 1710 MHz and 1890 MHz whereby the components described in the invention are integrated into the respective terminal devices and handheld technologies.

2. Description of Related Art

Familiar antenna solutions for the area of mobile communications applications are based on linear antenna designs in the form of single-pole applications in shortened or unshortened execution. These linear antennas are familiar both as externally installed aerial antennas [Bordantennen] an as components that are integrated directly with the terminal device, as well as those affected by various directional factors and effectiveness, whereby these components are exclusively omnidirectional at the azimuth level. Familiar flat antenna solutions are based on planar arrangements similar to dipolar configurations whose radiation pattern is irregular and exhibits and, in conjunction with the respective antenna support or antenna body, the characteristics of a significant radiation field deformations. The radiation field properties relevant to the area of application are clearly inferior to those of the classical linear antenna. Likewise, fade or tune out properties of the radiation pattern are not demonstrable. Furthermore there are no known solutions, whose electromagnetic or radiation characteristics are achieved on the basis of asymmetrical and open wave guide technology, particularly that of micro-strip technology, using foil circuitry or foil-like conducting surfaces.

The azimuth omnidirectional antenna configuration elaborated in Patent DE 41 13 277 proceeds exclusively from a foil as a structural support, whereby the described antenna component is subject to a capacitative top loading outside of the terminal device container. In like manner, the azimuth omnidirectional antenna configuration illustrated in Patent DE 41 21 333 starts with an electrically non-conducting foil as a mechanical structural support, whereby the main radiation direction with respect to the elevations exhibits a slope of approximately (minus) −30° (degrees of angle); that is, it exhibits a negative elevation angle.

SUMMARY OF THE INVENTION

Thus, the disadvantage of the conventional antenna configurations is that they either are exclusively omnidirectional at the azimuth level or radiate merely within the negative angle range.

The purpose of the invention described herein is to provide a system integratable antenna component with the smallest possible surface expansion having the most unidirective azimuthal directional effect; that is, it provides the preferred coverage of a spatial hemisphere as well as a limited angular shift within the positive range of elevation angle.

This purpose is achieved by the invention described herein by the characteristics of the identifying portions of Claim 1 and the subordinate claims that refer back to Claim 1.

In the case of the antenna described in the invention and which can be characterized as a radiating foil, we refer to a modified λ/4 radiator [antenna] which is shorted on the one side against ground. In order to achieve the most compact construction the longitudinal conductor segment, which serves as the resonator, is designed as λ/4. In this manner, the resonator becomes, however, inductive and the vibratory condition is not fulfilled. At the opposing end of the resonator on the side to be shorted, an end capacitance is produced so that the resonance requirement [condition] can be obtained. Said end capacitance is produced by at least on additional conductive segment which is connects to the end of the resonator lying opposite the side to be shorted and which forms an open circuit [no-load] at its other end. The length of the additional conductive segment determined by the vibratory condition and thus the resulting resonance frequency of the entire structure. Here, various design forms of the conductive segment at the end of the resonator are conceivable for the realization of a defined end capacitance. The end capacitance can be realized by one or several circuits of appropriate lengths that do not necessarily have to be parallel to one another or run to the resonator. All circuits can likewise be laid out in whatever curvature and not exclusively straight linear form.

By covering the antenna or the foil radiator foil using an additional dielectric layer, which is not considered in the design process, significant desensitization vis-à-vis other dielectrics in proximity to the radiator (antenna) can be achieved. This is important in that by integrating the foil antenna into radio devices (dielectric effect) and by the affect that results by holding the radio device in the hand, functionality is preserved and the antenna is not detuned or maladjusted.

Since in this type of antenna the one side is shorted, there is only one transmitting or receiving end. This results in a dyssymmetry or the directive characteristics in the vibratory plane of the electrical field vectors (E-planes) and thus in an angular shift of the main transmission direction in said plane of approximately 30° in the line of sight on the shorted transmitter side—transmitting end.

The electrical properties of these antennas; such as, for example, quality, impedance bandwidth, gain and efficiency depend on the size of the mechanical shortening attained (reduction), the breadth of the resonator, the distance between the resonator and the end capacitance circuit segments, the effective permissibility [permitivität] constants, the substrate thickness or the dielectric loss angle.

By using the present invention, it is possible to install two or more antennas for different wavelengths in a relatively small space. An essential characteristic of the invention is that the resonators realized using micro-strip technology for receiving the microwaves are created shorter than $\lambda_g/4$ and, as already mentioned, the vibratory condition is no longer met. The required end capacitances are realized by additional conductor segments. An enlargement of the frequency bandwidth can be achieved by additional antenna elements by electromagnetic coupling. This is done by additional micro-strip circuits that are arranged at certain intervals to the resonator and its end capacitances. It is possible, using two or more resonators on a single substrate, to receive several wavelengths, whereby the resonators can be spatially arranged interleaved within one another and tuned to the required frequency bands. The individual antennas need not be arranged on one plane, but can also be arranged in layers. In this manner it is also possible, that per layer several antenna arrangements can be provided, so that more than two different frequency bands are served. In this situation it is possible that a mobile radio-telephone can communicate with different mobile communications networks.

These and other features of the invention will be more understood by reference to the following drawings:

BRIEF DESCRIPTION OF THE DRAWINGS

FIGS. 8, 9A, 9B to 10: An antenna as shown in FIG. 2, in which several resonators interleaved into each other are provided for the purpose of increasing the frequency bandwidth.

DETAILED DESCRIPTION OF THE INVENTION

Figure 1:
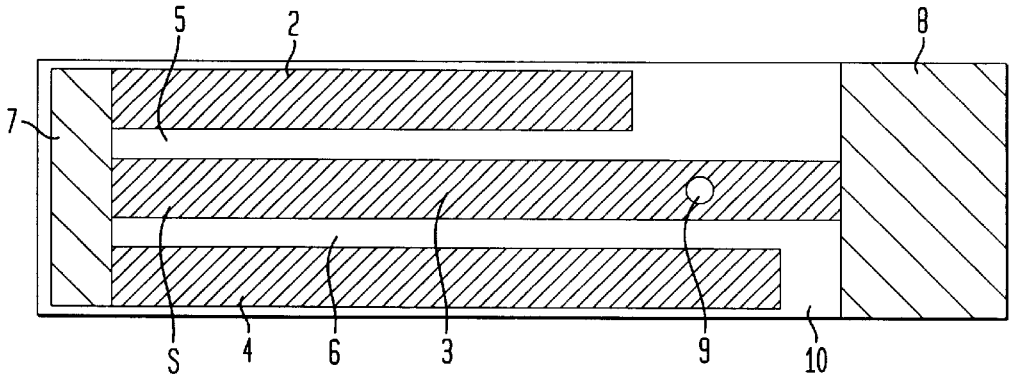
FIG. 1: An antenna pursuant to the invention with a resonator connected to the ground layer and two conductor segments, representing the end capacitances, abutting the resonators bilaterally.
Figure 2:
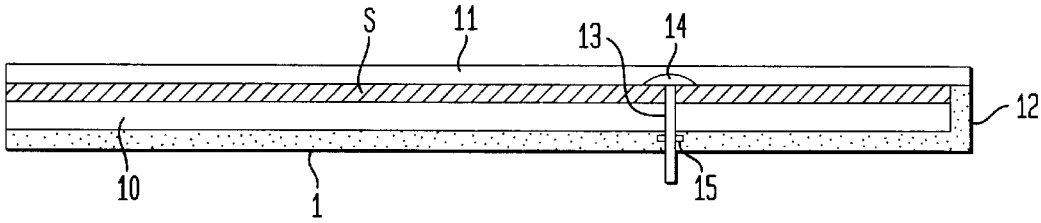
FIG. 2: An illustration in cross-section of the antenna as described in FIG. 1.

FIG. 1 shows an antenna as described in the invention with a foil-like low-dielectric support (10), which is layered on one side with a conductive structure (S) consisting of conductor sections 2, 3, and 4 running in straight lines and parallel to each other, whereby the conductor section 3 is conductive and connected on one side with a grounding surface (8), which in turn, as shown in FIG. 2, is in connection with the ground plane (1) by way of a conductive coating of the cross-section area of the support substrate (1). Instead of the conductive coating (12) the ground layer (8) (design example not shown) can be connected to the ground plane (1) by means of on or several terminal pins, which pass through the substrate layer (10). The conductive coating of the cross-section plane of the support substrate (10) shown in FIG. 2 does not necessarily have to run over the entire width of the antenna, but it can impinge on a partial coating of the foil cross-section plane [folienquerschnittsflache]. The conductive sections (2, 3, and 4) are each arranged separated from one another by a definite gap, whereby the conductive sections (2, 3, 4) each are conductively connected by strip-like conductor section (7) running diagonally in a defined section length- and width, whereby the running diagonally conductive section is arranged at the conductor section end of the antenna lying opposite the ground contact (8). The conductor section (3) that is connected to a ground layer (8) at a conductor section end and with the diagonal strip-like conductor section (7) at its opposite end, is coupled at site (9) with a signal wave conductor, in that the center conductor (13) of a coaxial wave guide [wellenleiter] is arranged through an aperture (15), which is arranged in the reverse ground plane (1), centrally guided and coupled with the conductor section (3) at site (9) on the longitudinal symmetry line of the of the conductor segment, and the external conductor of the coaxial wave guide is connected conductively with the reverse ground plane (1) to the aperture rim (15).

The vibratory condition of the open and non-symmetrical wave guide structure in the form of micro-strip technology is determined over the geometric length and breadth of the conductor sections (2, 3, and 4). The starting impedance of the micro-strip arrangement is determined over the input coupling point (9) along the line of symmetry of the conductor section (3), which in turn is dependent on the resultant length of the conductor sections (2 and 4), whereby the signal input and output coupling occurs at the point (9) via a circular coaxial aperture or a slit or quadrilateral shaped aperture.

Detuning of the antenna as a result of dielectric environmental influences is compensated over the length of the conductor sections (2 and/or 4), whereby the degree of detuning of the antenna as the result of dielectric environmental factors is affected or minimized by the application of a dielectric layer (11) of a defined dielectric number as well as of a defined geometry.

The dielectric support layer (10) is particularly a polystyrol foil having a layer thickness of 1 mm that is provided on the one side over its entire area with a copper or aluminum foil of a layer thickness of between 0.01 mm and 0.5 mm that forms the ground plane. As shown in FIG. 2 the same polystyrol support is provided with a foil-like structure (S) consisting of copper or aluminum having a layer thickness of between 0.01 mm and 0.5 mm, and consisting of the conductor sections (2, 3, 4) running in a straight line, parallel to each other and separated by a longitudinal gap. The dielectric layer (11) likewise has a layer thickness of approximately 1 mm.

In a particular design form the antenna has a length $L_A$ of 199 mm and a width of $B_A$ of 40 mm. The length $L_A$ of the ground plane (8) is 20 mm. The distance LB from the ground plane (8) to the feeder point of the antenna (9) likewise is 20 mm. The diameter of the aperture (15) is 4.1 mm. The length of the conductor section forming the end capacitance $K_1$ and $K_2$ are measured at 82.6 mm and 56.7 mm. The length $L_A$ of the conductor section (3) forming the resonator R measures 85.7 mm. The width of the conductor section (2) is 11.5 mm, and the width of the conductor section (4) is 9.5 mm. The width of the resonator conductor section is 12 mm.

Figure 3:
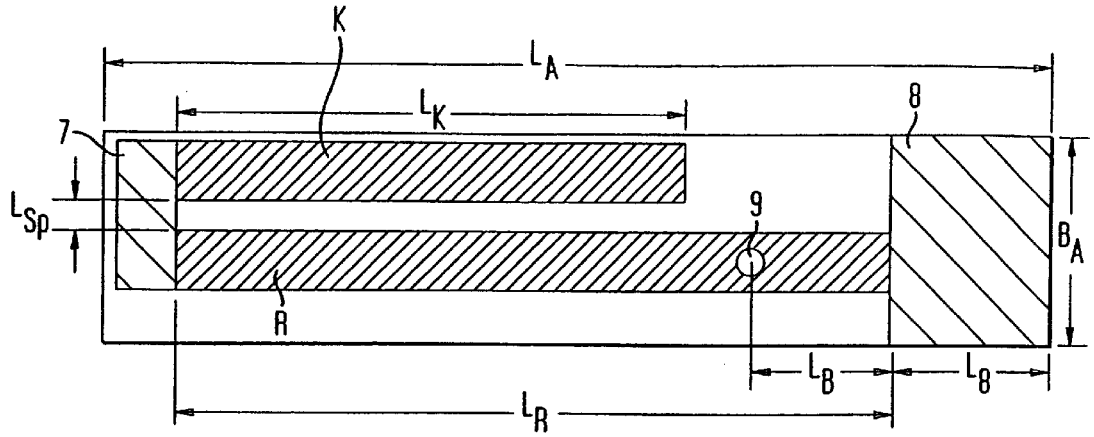
FIG. 3: An antenna as described in FIG. 1 with only one conductor segment creating the end capacitance.

FIG. 3 shows an antenna as described in the invention in which solely a conductor 10 section (K) running parallel to the resonator conductor section (3) or to R forms the end capacitance.

Figure 4:
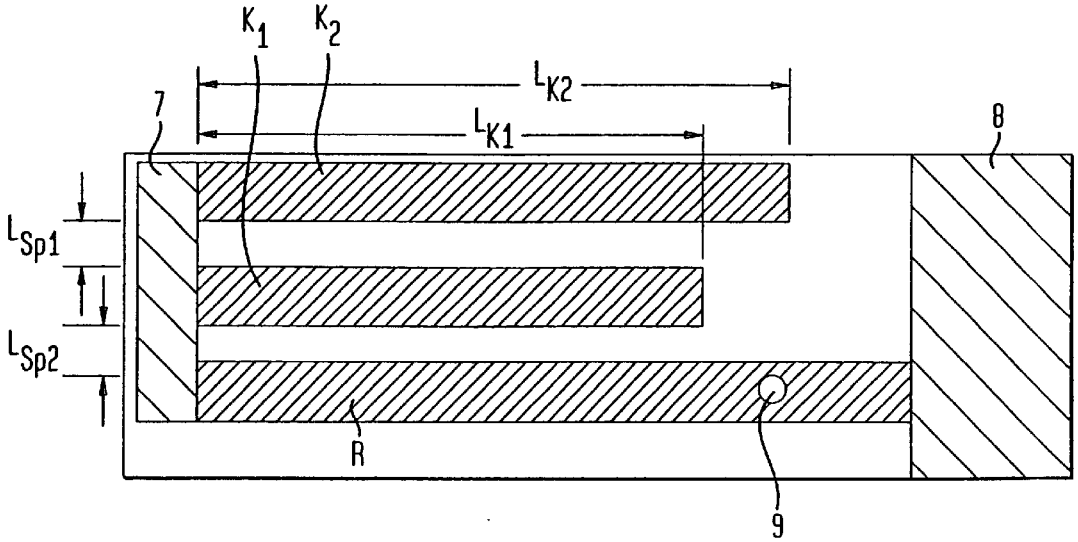
FIG. 4: An antenna pursuant to FIG. 1, in which the conductor section is situated on one side of the resonator.
Figure 5:
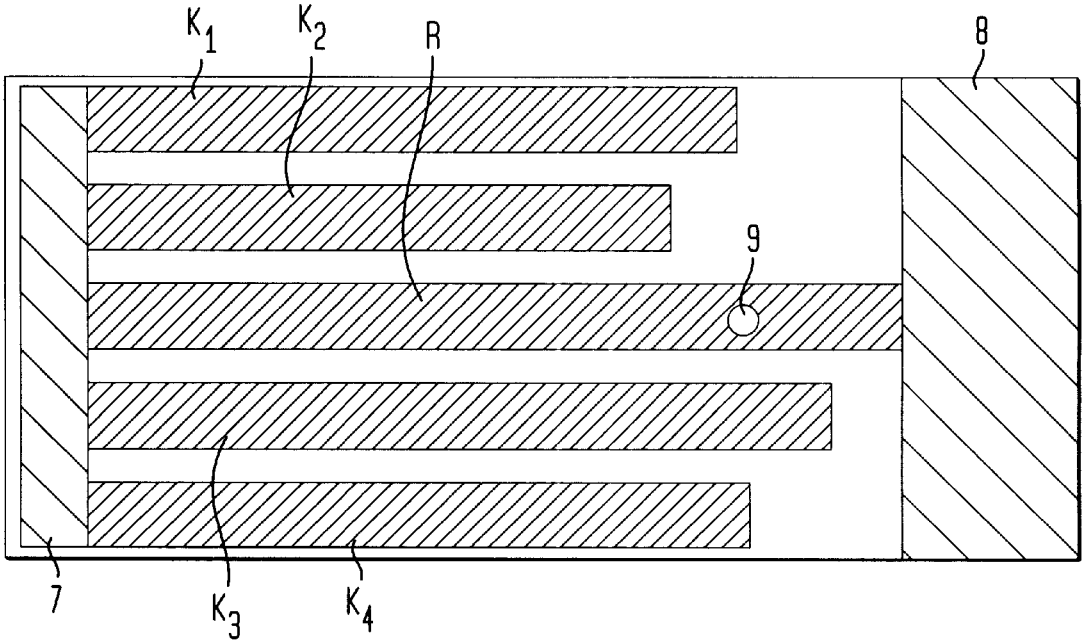
FIGS. 5 and 6: An antenna with 4 and 3, respectively, conductor sections forming the end capacitances.
Figure 6:
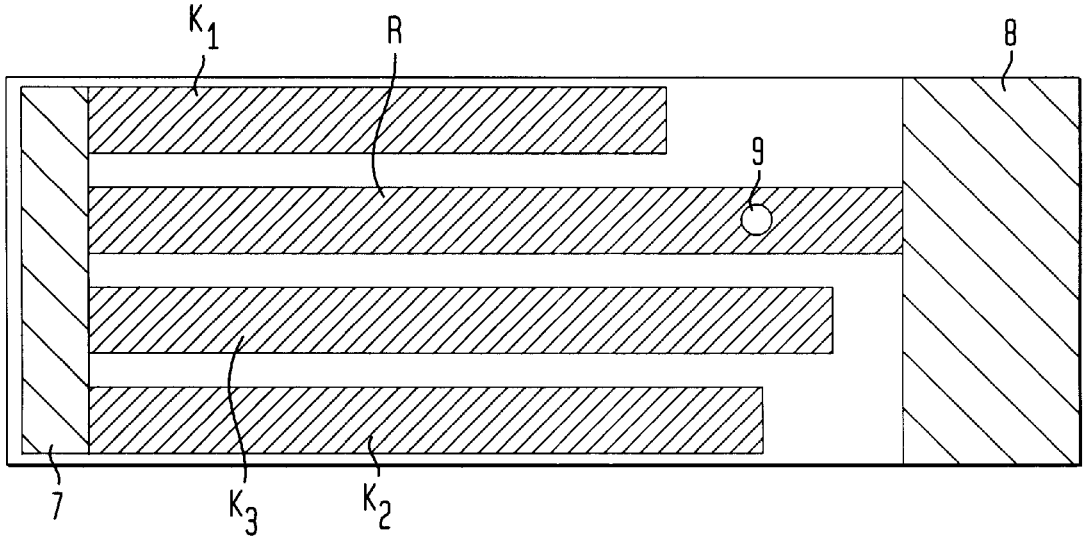

FIG. 4 shows an antenna as described in the invention in which the end capacitance is formed by two parallel conductor sections, $K_1$ and $K_2$, which are arranged on one side of the resonator conductor section R. Likewise, as illustrated in FIGS. 5 and 6, an antenna can be configured in which the resulting end capacitance is achieved by three or four conductor sections, $K_1$ to $K_4$.

Figure 7:
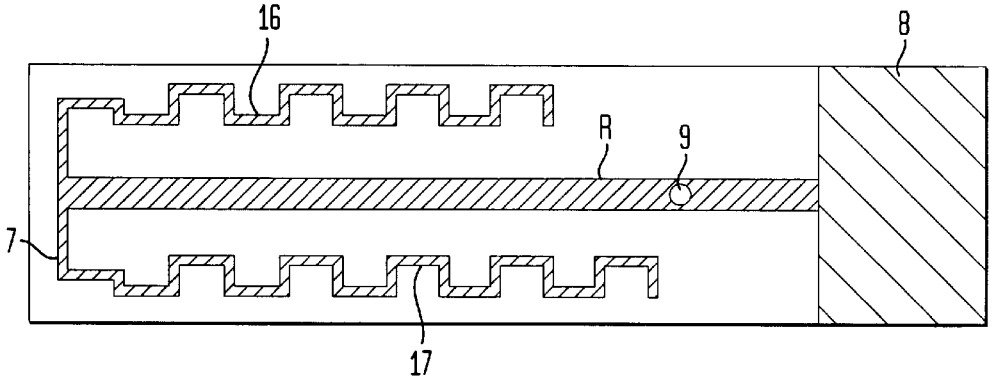
FIG. 7: An antenna, whose end capacitance conductor sections are not formed linearly straight, but angular.

FIG. 7 illustrates an additional design form of the antenna as described in the invention in which the conductor sections (16 and 17) that form the end capacitance are not straight linear, but run an angular course.

Figure 8:
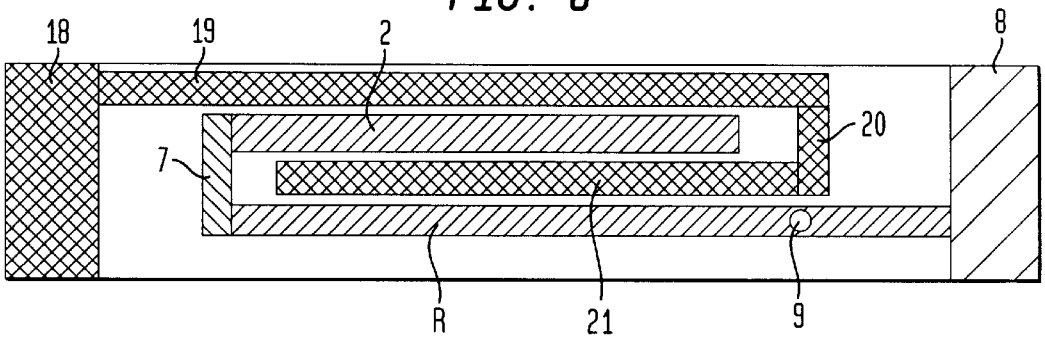
Figure 9A:
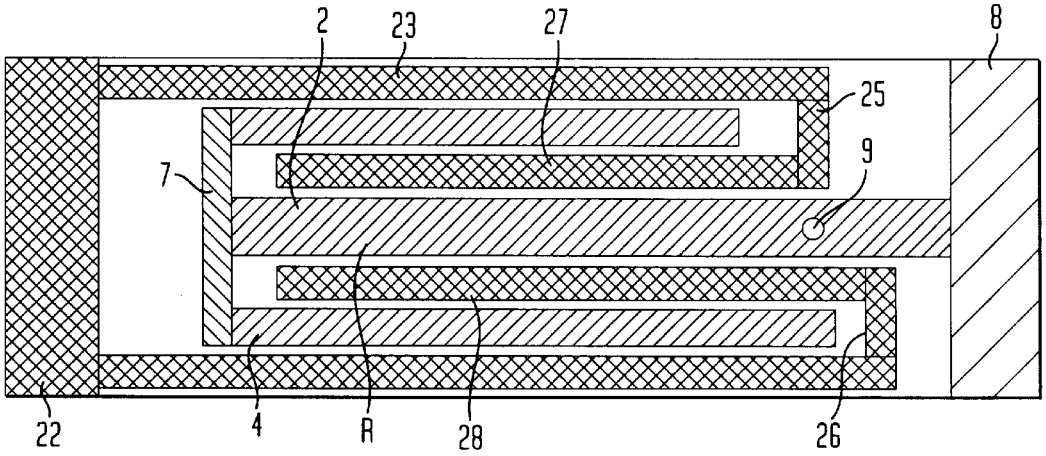
Figure 9B:
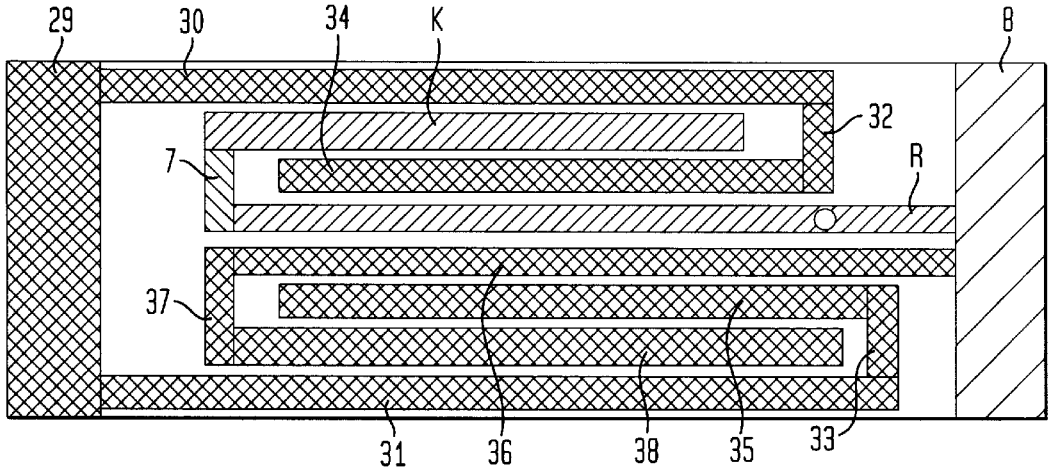
Figure 10:
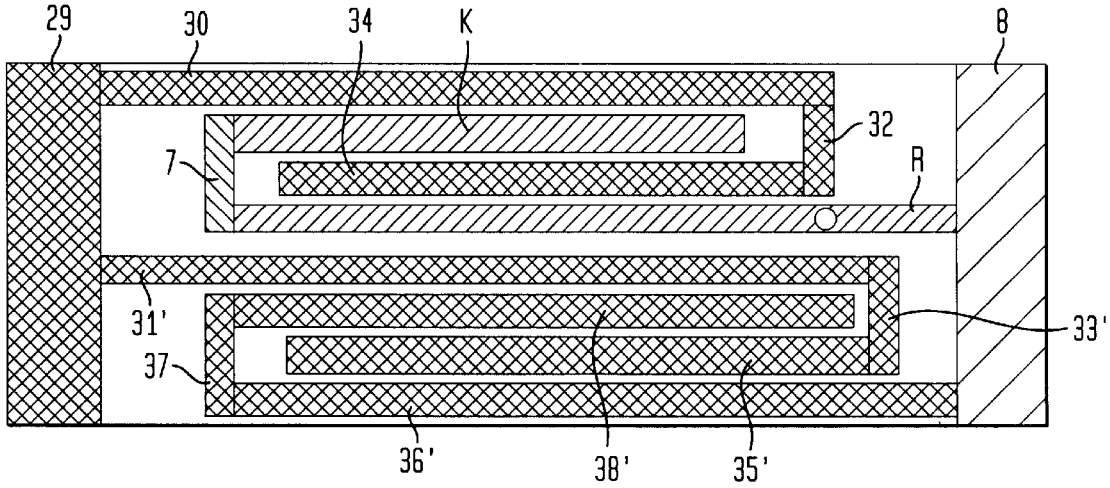
Figure 11:
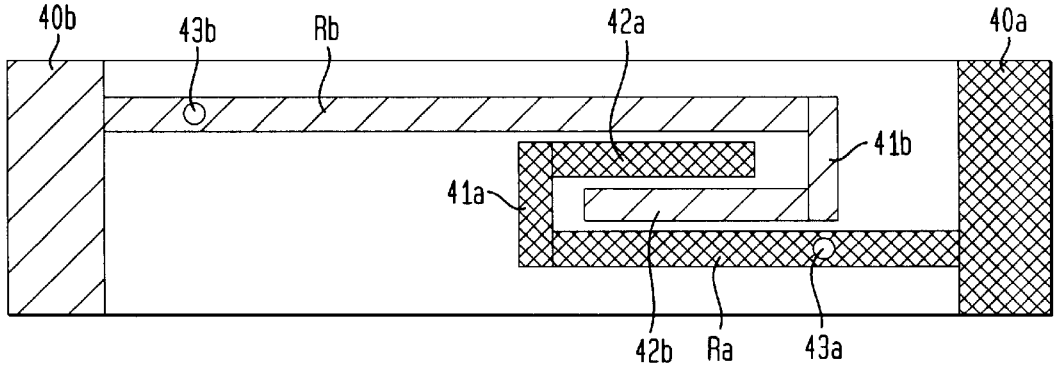
FIG. 11: Two antennas, interleaved into each other as described in the invention, for reception of two frequency bands.

FIGS. 8 to 10 illustrate antennas in which the frequency bandwidth of the antenna is adjusted or expanded by electromagnetic coupling with supplemental conductor elements that are arranged on the same dielectric support substrate. The antenna pursuant to FIG. 8 corresponds in its basic construction to the antenna shown in FIG. 3, wherein a U-shaped conductor section (19, 20, 21) inserts with one of its arms (21) into the space between the resonator conductor section (3) and conductor section (2), that forms the end capacitance. The other arm (19) is connected with a supplemental ground surface (18), which is correspondingly connected with the ground plane (1) corresponding to the ground surface (9). FIG. 9B corresponds in its basic structure to FIG. 1, whereby two additional U-shaped conductor sections (23 to 28) are provided and which each with its arm (27, 28) intrude into the space formed by the conductor sections (2, R, 4).

FIGS. 9 and 10 illustrate other possible executions of the antenna described in the invention, whereby the arrangement of the additional conductor segments (30 to 38) whose coupling for the purpose of enlargement of the frequency bandwidths is, in principle, optional. It is also conceivable that the conductor segments enmesh helically with each other, such that a long parallel lead of conductor segments in a relatively minimal space is obtained.

FIGS. 11 to 14 illustrate antennas, in which two antenna signals can be coupled in and coupled out, whereby two frequency bands can be simultaneously received or served by using only one foil antenna. Through the variable layout of the resonator conductor section $R_a$ and $R_b$ the resonance conditions are determined in conjunction with the conductor sections 41*a, b* and 42*a, b*, as well as points 43*a*, 43*b* of the outcoupling of the electromagnetic waves. Through the interleaving of the two antenna arrangements they can be arranged in the most confined space.

Figure 12:
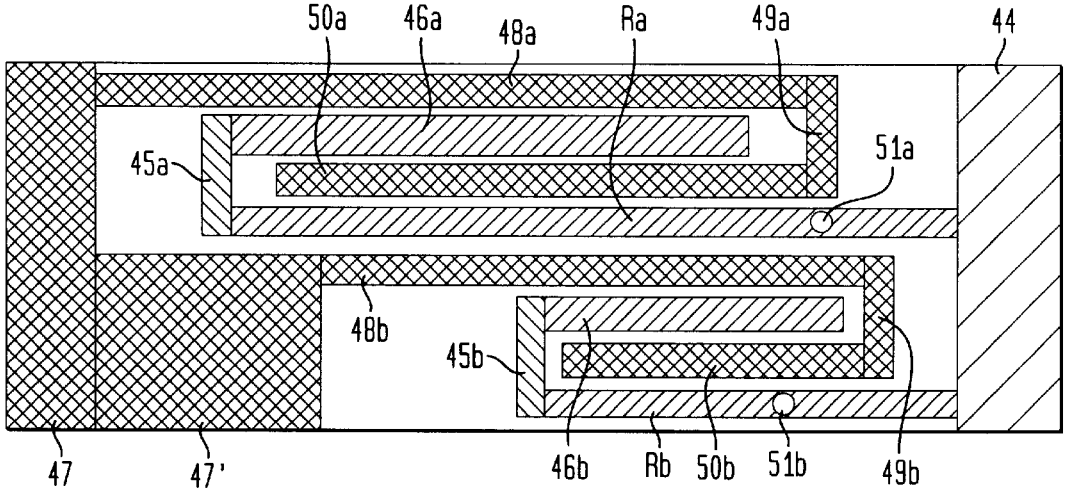
FIG. 12: Two antennas as described in the invention and arranged on a substrate for the reception of two frequency bands with one supplemental coupler each for the increase of the respective frequency bandwidth.

FIG. 12 illustrates another design form of an antenna using two connections (51*a*, 51*b*) for dielectric wave guides, whereby only the antenna layout illustrated in FIG. 8 with the respective dimensioning are arranged alongside one another on one substrate support.

Figure 13:
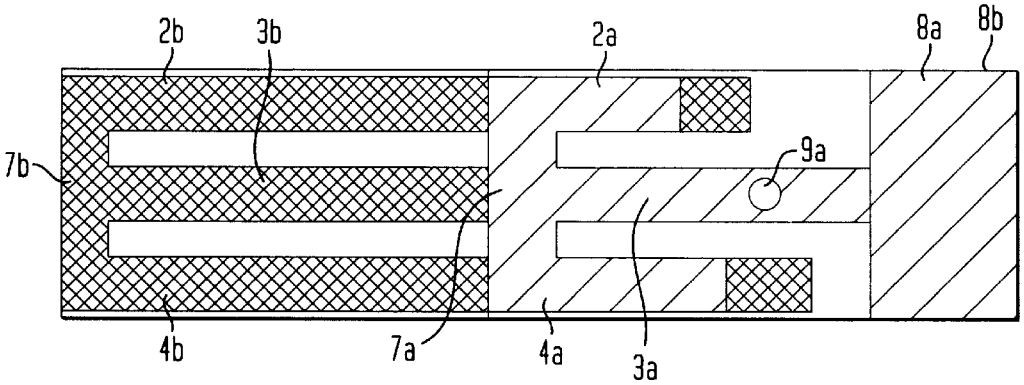
FIG. 13: View from above onto a planar-antenna for the reception of two frequency bands.
Figure 14:
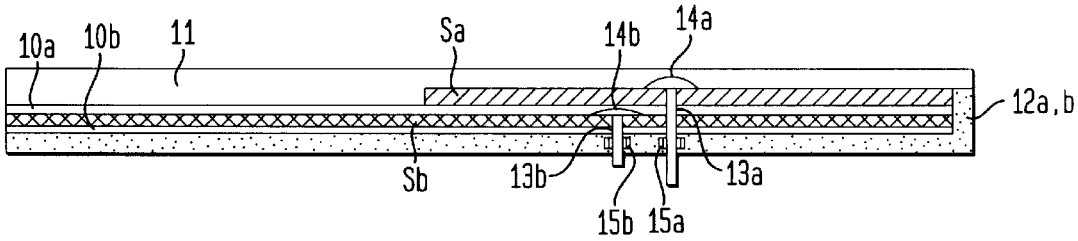
FIG. 14: A cross-section illustration of an antenna as described in FIG. 13.

FIGS. 13 and 14 illustrate a multilayer antenna in which the antennas as described in the invention are arranged sandwich-fashion over one another in several layers, whereby one antenna corresponds to the vibratory/oscillatory conditions for the frequencies of a particular mobile communications network. Through the different resonance frequencies the antenna structures arranged above one another interfere only minimally with each other. In comparison to the arrangement shown in FIG. 2, less space is required in the case of layering of the antenna structures, whereby the antenna as described in FIG. 13 can be compactor and thus, the mobile telephone device housing enclosing it can be designed to be relatively small.

FIG. 14 illustrates the antenna as described in FIG. 13 in cross-section. The conductive coating (12*a, b*) of the cross-sectional area of the support substrate (10*a* and 10*b*) is conductively connected with the structured layers $S_A$ and $S_B$. Such a conductive cross-sectional coating is feasible also on the opposite side depending on the antenna construction.

It is clear that depending on the desired resonance frequency, coupling, and tuning the respective geometries of the individual conductor sections must be selected accordingly, whereby the geometries of the conductor structures must sometimes be empirically determined for achievement of the programmed frequencies.

While the invention has been described with reference to the above embodiments, it will be appreciated by those of ordinary skill in the art that various modifications can be made to the structure and function of the individual parts of the system without departing from the spirit and scope of the invention as a whole.

REFERENCE DRAWING LIST

1 Ground Plane
2, 2*a*/*b*, 4, 4*a*/*b* Conductor Section as End Capacitance
6*a*/*b*, K, $K_I$ Resonator Conductor Section
5, 6 Spacing Gap between the end capacitance conductor sections and the resonator conductor sections
7, 7*a*/*b* Resonator conductor sections with transverse conductor section end capacitance
41*a*/*b*, 45*a*/*b* sections connecting end capacitance conductor sections
8 Ground Surface; in conjunction with the Ground Plane (1)
9 Feeder Point of the Antenna
10 Dielectric Support Layer
11 Dielectric Layer
12 Conductive Coating of the Transverse Surface of the Support Substrate
13, 13*a*, 13*b* Internal Conductor of a Coaxial Wave Guide
14, 14*a*, 14*b* Solder Point
15, 15*a*, 15*b* Aperture
16, 17 Conductor Section as End Capacitance in Angular Wave Shape
18, 22, 29, 40*b*, 47 Additional Ground Surface; in conjunction with the Ground Plane
19–21; 23,-28 Additional, essentially U-shaped Conductor Section
30–35; 31', 33'
35', 48*a*/*b*–50*a*/*b*
36, 37, 38, 36' Conductor Section for Adjustment/Setting of the Antenna [De]Tuning
37', 38', 40*b*
$B_A$ Width of the Antenna
$L_B$ Length of the Ground Plane B
$L_A$ Length of the Antenna
$L_B$ Distance of the Coupling-In Point from the Ground Surface (8)
$L_R$ Length of the Resonator Conductor Section
$L_{Ki}$ Length of the End Capacitance Conductor Sections
$L_{SP}$, $L_{SPI}$ Width of the Separation Gap
S, Sa, Sb Conductive Layer Structured as Micro-strip Circuits

What is claimed is:

1. An antenna for receiving and transmitting of electromagnetic microwaves of wavelength λ, consisting of a substrate layer (10) made of low-dielectric material, which on one side is provided with conductive ground plane (1) and whose opposite side is a conductive structure in the form of micro-strip circuits, and charaterized by the face that the conductive structure (S) has a longitudinal conductor section (3, 3*a*, 3*b*, R, Ra,Rb) as resonator, whose length ($L_R$) is shorter than $\lambda_g/4$, and which is conductively connected with the ground plane (B, 1) at its end, and whose other end is conductively connected with at least one other conductor section (2, 2*a*, 2*b*, 4, 42*a*, 42*b*, 46*a*, 46*b*,K), which serves as end capacitance for the purpose of adjusting the resonance condition, whereby the resonator conductor section (3, 3*a*, 3*b*, R, Ra, Rb) is in connection with the ground plane (1) using an internal conductor of a coaxial wave guide and the external conductor of the coaxial wave guide.

2. An antenna as described in claim 1 and characterized by the fact that the at least one additional conductor section (2, 2*a*, 2*b*, 4, 42*a*, 42*b*, 46*a*, 46*b*, K) is constructed as a micro-strip circuit and arranged parallel to the resonator conductor section (3, 3*a*, 3*b*, R, Ra, Rb).

3. An antenna as described in claim 1 and characterized by the fact that the resonator conductor section (3, 3*a*, 3*b*, R, Ra, Rb) is conductively connected with an additional conductor section (2, 2*a*, 2*b*, 4, 42*a*, 42*b*, 46*a*, 46*b*, K) in such manner that the two conductor sections section (2, 2*a*, 2*b*, 4, 42*a*, 46*a*, 46*b*, K; 3, 3*a*, 3*b*, R, Ra, Rb) together with the connection conductor section (17, 41*a*, 45*a*, 45*b*, 49*a*, 49*b*) connected to them form a U with arms of equal or different lengths.

4. An antenna as described in claim 1 and characterized by the fact that at least two additional conductor sections (2, 2*a*, 2*b*, 4, 42*a*, 42*b*, 46*a*, 46*b*, K), which are particularly arranged parallel to the resonator conductor section (3, 3*a*, 3*b*, R, Ra, Rb), each connected by its one end with the end of the resonator conductor section (3, 3*a*, 3*b*, R, Ra, Rb) via a connection circuit (7, 41*a*, 41*b*, 45*a*, 45*b*, 49*a*, 49*b*) running transversely to the longitudinal line of symmetry of the resonator conductor section (3, 3*a*, 3*b*, R, Ra, Rb), whereby the other conductor sections (2, 2*a*, 2*b*, 4, 42*a*, 42*b*, 46*a*, 46*b*, K) are distributed either on one side or on both sides, whereby particularly the length ($L_k$) of the other conductor section (2, 2*a*, 2*b*, 4, 42*a*, 42*b*, 46*a*, 46*b*, K) is different.

5. An antenna as described in claim 1 and characterized by the fact that the one end of the resonator conductor section (3, 3*a*, 3*b*, R, Ra, Rb) is connected to the ground plane (1) by at least one terminal pin passing through the substrate layer (10, 10*a*, 10*b*).

6. An antenna as described in claim 1 and characterized by the fact that the one end of the resonator conductor section (3, 3*a*, 3*b*, R, Ra, Rb) is connected via a conductive coating (12, 12*ab*) to the the transverse surface of the substrate layer (10, 10*a*, 10*b*).

7. An antenna as described in claim 1 and characterized by the fact that at least on additional conductor section (2, 2*a*, 2*b*, 4, 42*a*, 42*b*, 46*a*, 46*b*, K) is formed as straight linear, angular, bent/curved, wavelike, zigzag, or right-angular.

8. An antenna as described in claim 1 and characterized by the fact that that for the purpose of adjustment of the resonator condition, at least one additional, essentially U-shaped conductor section (19, 20, 21; 23–28; 30–35; 31', 33', 35'; 48*a*/*b*–50*a*/*b*) is arranged on the substrate layer (10), whereby one arm (21, 27, 28, 34, 35, 35', 50*a*, 50*b*) of said U-shaped additional conductor section impinges into the opening formed by the resonator section (3, 3*a*, 3*b*, R, Ra, Rb) and the additional conductor section (2, 2*a*, 2*b*, 4, 42*a*, 42*b*, 46*a*, 46*b*, K) and the end of the other arm (19, 23, 24, 30, 31, 48*a*, 48*b*) of the additional conductor section is connected to the ground plane (1, 18, 22, 29, 47, 47').

9. An antenna as described in claim 8 and characterized by the fact that the additional U-shaped conductor section (Rb, 41*b*, 42*b*) is an antenna for transmitting and receiving electromagnetic waves, whereby the waves are coupled in or coupled out from the conductor section (Rb) connected to the ground plan (1, 40*b*) in such a way that the interleaving structures of the antennas affect the resonance conditions and/or tuning of the individual resonators by reciprocal electromagnetic coupling and an expanded frequency range is achieved.

10. An antenna as described in claim 1 and characterized by the fact that several antennas for transmitting and/or receiving different wavelengths are arranged on the substrate layer (10, 10*a*, 10*b*) alongside each other and which are each coupled with a coaxial wave guide.

11. An antenna as described in claim 1 and characterized by the fact that several antennas each separated by at least one substrate layer (10*a*) are arranged on top of one another.

12. An antenna as described in claim 1 and characterized by the fact that that the internal conductor (13, 13*a*, 13*b*) of the coaxial wave guide is lead through an aperture (15, 15*a*, 15*b*) in the ground plane (1) and a recess in the layer (10, 10*a*, 10*b*) and connected to the resonator conductor section (3, 3*a*, 3*b*, R, Ra, Rb), whereby the input impedance of the antenna is determined over the point (9) of the in-coupling along the longitudinal line of symmetry of the resonator conductor section (3, 3*a*, 3*b*, R, Ra, Rb).

13. An antenna as described in the foregoing claim 12 and characterized by the fact that the aperture (15, 15*a*, 15*b*) is circular, slit-like, or rectangular.

14. An antenna as described in claim 1 and characterized by the fact that the tuning of the antenna as a result of dielectric environmental factors is compensated over the length of the additional conductor sections (19, 20, 21; 23–28; 30–35; 31', 33', 35'; 48*a*/*b*–50*a*/*b*) and/or by the antennas arranged additionally on the substrate.

15. An antenna as described in claim 1 and characterized by the fact that that the degree of tuning of the antenna as a consequence of dielectric environmental factors is affected or minimized by the application of a dielectric layer (11) of a defined dielectric number and of a defined geometry, in particular thickness.

* * * * *